US010926566B2

(12) United States Patent
Zhou et al.

(10) Patent No.: US 10,926,566 B2
(45) Date of Patent: Feb. 23, 2021

(54) HEAT-SENSITIVE TREATMENT-FREE PLANOGRAPHIC PRINTING PLATE MATERIAL CONTAINING THERMOSENSITIVE PROTECTION LAYER AND APPLICATION THEREOF

(71) Applicant: Technical Institute of Physics and Chemistry of the Chinese Academy of Sciences, Beijing (CN)

(72) Inventors: Shuyun Zhou, Beijing (CN); Yingquan Zou, Beijing (CN); Jinying Liu, Beijing (CN); Fang Xing, Beijing (CN); Shizhuo Xiao, Beijing (CN); Ping Chen, Beijing (CN); Jian Zhao, Beijing (CN)

(73) Assignee: TECHNICAL INSTITUTE OF PHYSICS AND CHEMISTRY OF THE CHINESE ACADEMY OF SCIENCES, Beijing (CN)

( * ) Notice: Subject to any disclaimer, the term of this patent is extended or adjusted under 35 U.S.C. 154(b) by 189 days.

(21) Appl. No.: 16/344,526

(22) PCT Filed: Oct. 26, 2017

(86) PCT No.: PCT/CN2017/107840
§ 371 (c)(1),
(2) Date: Apr. 24, 2019

(87) PCT Pub. No.: WO2018/082499
PCT Pub. Date: May 11, 2018

(65) Prior Publication Data

US 2019/0283480 A1 Sep. 19, 2019

(30) Foreign Application Priority Data

Nov. 4, 2016 (CN) ..... 201610964541.5

(51) Int. Cl.

| | |
|---|---|
| ***B41N 1/12*** | (2006.01) |
| ***B41C 1/10*** | (2006.01) |
| ***B41N 1/08*** | (2006.01) |

(52) U.S. Cl.
CPC ..... *B41N 1/12* (2013.01); *B41C 1/1016* (2013.01); *B41N 1/083* (2013.01); *B41N 2207/14* (2013.01)

(58) Field of Classification Search
None
See application file for complete search history.

(56) References Cited

U.S. PATENT DOCUMENTS

2013/0052436 A1* 2/2013 Yang ..... G03F 7/0388 428/212

FOREIGN PATENT DOCUMENTS

| | | |
|---|---|---|
| CN | 1490667 | 4/2004 |
| CN | 101954776 | 1/2011 |
| CN | 103068583 | 4/2013 |
| CN | 104742492 | 7/2015 |
| CN | 105372935 | 3/2016 |
| CN | 106364209 | 2/2017 |
| EP | 1226936 | 7/2002 |

OTHER PUBLICATIONS

International Search Report filed in PCT/CN2017/107840 dated Feb. 1, 2018.

* cited by examiner

*Primary Examiner* — Joshua D Zimmerman
(74) *Attorney, Agent, or Firm* — Rankin. Hill & Clark LLP

(57) ABSTRACT

Disclosed is a heat-sensitive processless planographic printing plate material containing a thermosensitive protection layer. The planographic printing plate material sequentially comprises a supporting body, a hydrophilic layer, a heat-sensitive layer and a thermosensitive protection layer from the bottom up. The thermosensitive protection layer therein can not only isolate oxygen and protect the heat-sensitive layer from oxygen inhibition, but can also sense heat and allow a polymerization reaction to take place. Thus the binding force between same and the next layer is improved, so that the precision of printing plate images is high, the development performance is good, and the pressrun is high.

10 Claims, No Drawings

HEAT-SENSITIVE TREATMENT-FREE PLANOGRAPHIC PRINTING PLATE MATERIAL CONTAINING THERMOSENSITIVE PROTECTION LAYER AND APPLICATION THEREOF

FIELD OF THE INVENTION

The present invention relates to planographic printing plate material, in particular to a heat-sensitive treatment-free planographic printing plate material containing a thermosensitive protection layer and application thereof.

BACKGROUND OF THE INVENTION

In recent years, digital technology is widely used to computerize the processing, storage and output of image and text information, and CTP technology is one of the most attractive technologies. CTP technology is a technology that uses laser and other highly-directional light, scans according to digital image information, and manufactures printing plates directly. In addition, for the traditional printing plate which needs processing after development, we can enumerate the plate-making defects caused by dynamic factors of the developer, such as the change of the pH value of the developer or the accumulation of the components of the photosensitive layer in the developer, which leads to the decrease of the developability, etc. Needless to say, the production cost of the developer, the cost in treating waste developer and the environmental pollution caused by industrial emissions have increased people's expectations for treatment-free plates.

The treatment-free CTP plates are mainly divided into three types, i.e., heat-sensitive type, photosensitive type and inkjet type. The main problem of the inkjet CTP plate is that the image accuracy is not as good as that of heat-sensitive and photosensitive CTP plates. The photosensitive CTP plate is mainly of a microcapsule type. The main problem is that it needs protective glue to assist development after exposure. Moreover, due to the poor adhesiveness between microcapsules and the supporting body, the printing resistance has certain defects. The biggest advantage of heat-sensitive CTP plate is that it can operate in a light room. The early heat-sensitive and treatment-free CTP plates are divided into a thermal ablation type and a thermal melting type. The thermal ablation treatment-free type has been gradually replaced by thermal melting technology due to the disadvantages such as that the exposure machine is easily contaminated because ablation residues are produced. The thermal melting CTP plate requires special glue to clear the unexposed area after exposure to obtain image and text information, which is equivalent to simplifying the "development" process. So another way of simplifying plate making is realized, which is called "on-machine development". On-machine development refers to a process of directly hanging the original printing plate on the printing machine after exposure of the original planographic printing plate without performing traditional development, and removing the unexposed area at the early stage of the printing process through plate moistening solution (exposed area is lipophilic) or ink (exposed area is hydrophilic). Fuji's on-machine development type heat-sensitive printing plate has the technical features that firstly a hydrophilic heat-sensitive layer is coated onto a plate base, then a hydrophilic layer and a water-soluble protection layer is coated, the hydrophilic layer contains an inorganic hydrophilic matrix, after exposure, the interaction between the lipophilic layer and hydrophilic layer decreases, during printing, the unexposed area of the lipophilic layer is enclosed by hydrophilic substances in the hydrophilic layer and ink and thus is removed, and the exposed area is left to form image and text information; adhesive polymers with epoxy alkyl groups are used in the image recording layer, hydroxyalkyl cellulose is used in the protection layer, the on-machine developability is improved, the interlayer mixing is inhibited, and the inking performance and printing resistance are improved. The patents that can be listed include JP 2002219881 and WO 2012/026265. Another on-machine development type heat-sensitive printing plate has the technical features that the plate base is coated with a heat-sensitive imaging layer, there is also a very thin water-soluble interlayer between the plate base and the heat-sensitive imaging layer, but the water-soluble interlayer is extremely thin, which will not affect the mechanical interlocking between the heat-sensitive imaging layer and the plate base, the heat-sensitive imaging layer is coated with a water-soluble protection layer, which is used to isolate oxygen and avoid oxygen inhibition, and the patent publication number is WO 02/21215 A1. The structure of the treatment-free heat-sensitive plate provided by Lucky HuaGuang Graphics Co., Ltd. comprises a supporting body, a heat-sensitive layer and a protection layer, wherein the heat-sensitive layer consists of a water-soluble thermal cross-linking copolymer, a cross-linking agent, a multifunctional monomer, a heat-sensitive initiator and an infrared dye. The water-soluble thermal cross-linking copolymer is a copolymer with an epoxy group, a cyano group and an ether bond on branched chains. The change in water solubility of the copolymer before and after exposure realizes water development, and the patent number is CN105372935A. The structure of the treatment-free heat-sensitive negative plate provided by Chengdu Keruiju Digital Technology Co., Ltd. comprises a supporting body and a heat-sensitive negative imaging element coated on it, the heat-sensitive negativity imaging element consists of hydrophilic polymer particles, hydrophobic polymer particles and energy conversion substances that may be contained, the irradiated part of the heat-sensitive negativity imaging element becomes a hydrophobic area, and the non-irradiated part retains its hydrophilic property, so that development on the fountain solution machine can be realized. The patent publication numbers that can be listed include CN101269564, CN101376305, CN101376305 and CN101376307. These inventions still have room for improvement when they need to meet the requirements of preventing plates being dirty (i.e., having good developability) and having printing resistance under various printing conditions.

SUMMARY OF THE INVENTION

One purpose of the present invention is to provide a heat-sensitive treatment-free planographic printing plate material containing a thermosensitive protection layer.

Another purpose of the present invention is to provide application of a heat-sensitive treatment-free planographic printing plate material containing a thermosensitive protection layer.

In order to achieve the above-mentioned purposes, the present invention adopts the following technical solution:

The planographic printing plate material sequentially comprises a supporting body, a hydrophilic layer, a heat-sensitive layer and a thermosensitive protection layer from bottom to top.

Further, the supporting body, the hydrophilic layer and the thermosensitive protection layer are hydrophilic, and the heat-sensitive layer is lipophilic or bi-affinitive (the bi-affinitive refers to having both hydrophilicity and lipophilicity).

Further, the supporting body in the present invention is a plate body or a film body capable of supporting a photosensitive layer.

Preferably, the plate body capable of supporting a photosensitive layer is an aluminum plate, and the film body capable of supporting a photosensitive layer is a variety of plastic films.

More preferably, the aluminum plate refers to an aluminum plate with one side in contact with the heat-sensitive layer, which is subjected to roughing treatment and anodic oxidation treatment; the plastic film is one or more of polyethylene terephthalate, polyethylene naphthalate, polyethylene, polypropylene, polystyrene, polyvinyl acetal, polycarbonate, cellulose diacetate and cellulose nitrate; and further preferably, the plastic film is polyethylene terephthalate or polyethylene naphthalate.

The roughening treatment method is a mechanical method or an electrolytic corrosion method; the mechanical method is not specially limited, and the wire brush grinding method is preferred; and the electrolytic corrosion method is not specially limited, and the electrochemical surface roughening method in acidic electrolyte is preferred.

The anodic oxidation treatment method is not specially limited and may be performed by using a well-known method.

The supporting body may be subjected to hole sealing treatment when it is subjected to anodic oxidation treatment; and the hole sealing treatment may be performed by using a well-known method such as hot water treatment, boiling water treatment, steam treatment, sodium silicate treatment, dichromate aqueous solution treatment, nitrite treatment or acetamide treatment.

In order to improve the hydrophilicity of these plastic films, hydrophilic processing is performed on the plastic film on the side in contact with the photosensitive layer; and the hydrophilic processing may be performed by adopting a well-known method such as corona discharge treatment, flame treatment, plasma treatment or ultraviolet irradiation treatment.

Further, the hydrophilic layer of the present invention is soluble in aqueous solution such as fountain solution, and is mainly composed of water-soluble resin.

Preferably, the water-soluble resin of the hydrophilic layer is one or more selected from a group consisting of polyvinyl alcohol, polyvinyl pyrrolidone, water-borne nylon resin, gelatin and cellulose derivative.

The hydrophilic layer is thin enough to not affect the linkage by means of mechanical interlocking between the heat-sensitive layer and the supporting body.

Further, the heat-sensitive layer comprises the following components in parts by weight: 10-60 parts of film-forming resin, 30-90 parts of cross-linking agent, 0-40 parts of diluting agent, 1-30 parts of polymerization initiator, 1-10 parts of infrared absorbing dye and 0.1-10 parts of coloring background dye; and preferably, the heat-sensitive layer comprises the following components in parts by weight: 20-50 parts of film-forming resin, 50-80 parts of cross-linking agent, 0-30 parts of diluting agent, 1-10 parts of polymerization initiator, 1-5 parts of infrared absorbing dye and 0.1-5 parts of coloring background dye.

Further, the film-forming resin is one or more of oil-soluble polymer with a weight-average molecular weight of 20000-100000 and water-oil-soluble polymer with a weight-average molecular weight of 10000-200000 and reactable carbon-carbon double bonds.

Preferably, the oil-soluble polymer is one or more selected from a group consisting of acrylic resin, anhydride resin, acrylate resin, styrene copolymer and polyvinyl butyral; and more preferably, the oil-soluble polymer is one or more selected from a group consisting of polystyrene, polybutyl isobutylene ester, polyethyl isobutylene ester, polymethyl isobutylene ester, polymethacrylate, polymethyl methacrylate, polyethyl methacrylate, polybutyl methacrylate, polyisobutyl methacrylate, polyvinyl acetate, polyvinyl chloride, styrene/acrylonitrile copolymer, cellulose acetate butyrate and polyvinyl butyral.

Preferably, the water-oil-soluble polymer is one or more selected from a group consisting of N-vinylamide copolymer (marked as Al, introduced from the patent application No. 201310158535.7), modified N-vinylpyrrolidone copolymer (marked as A2, introduced from the patent application No. 201410182220.0) and modified acrylate copolymer (marked as A3, introduced from the patent application No. 201410062775.1).

More preferably, the N-vinylamide copolymer (Al) is one or more having the following structural formulas:

A1-1

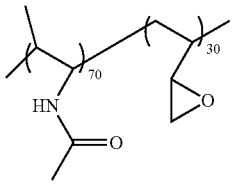

A1-2

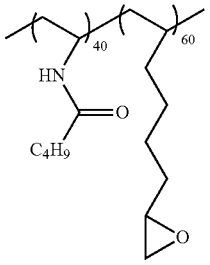

A1-3

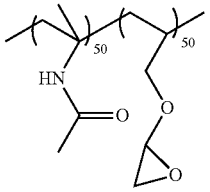

A1-4

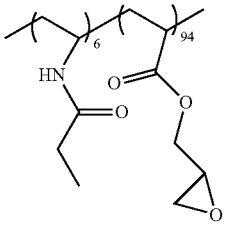

-continued
A1-5
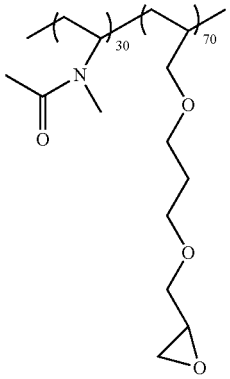
A1-6
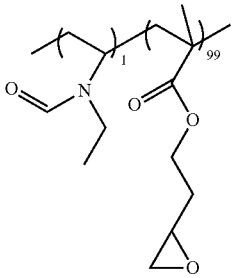
A1-7
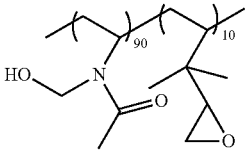
A1-8
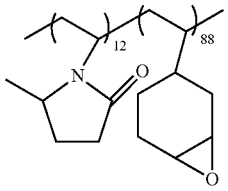
A1-9
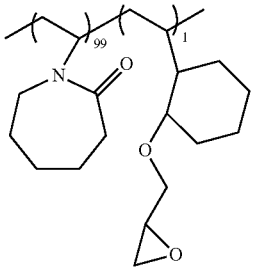
A1-10
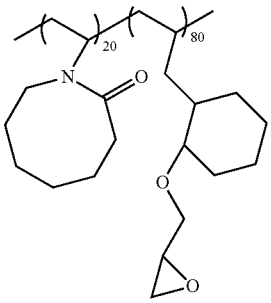
-continued
A1-11
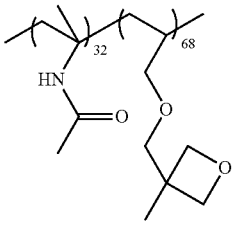
A1-12
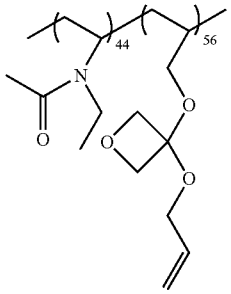
A1-13
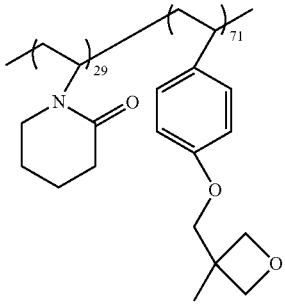
A1-14
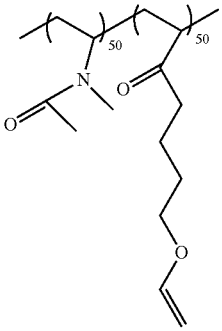
A1-15
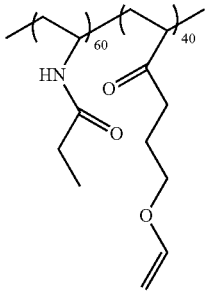

-continued
A1-16
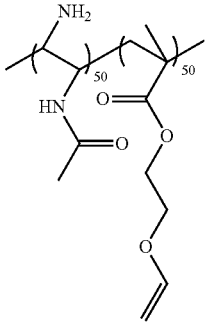
A1-17
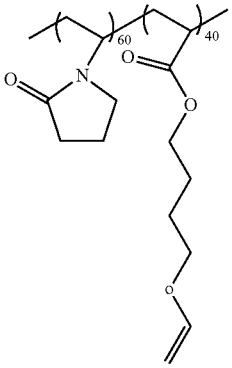
A1-18
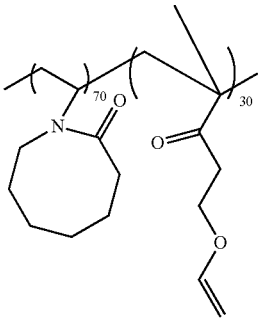
A1-19
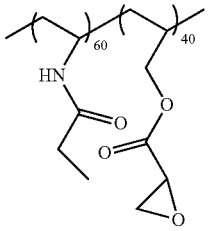
A1-20
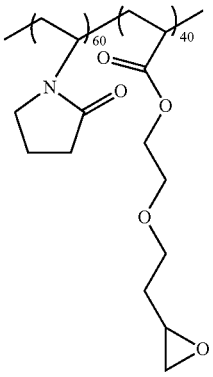
-continued
A1-21
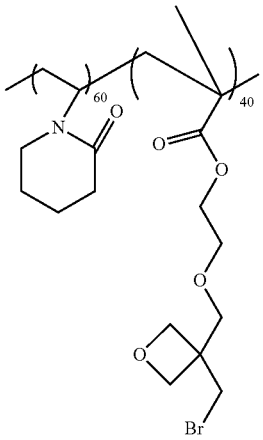
The structure of the modified N-vinylpyrrolidone copolymer is as shown by formula A2:
A2
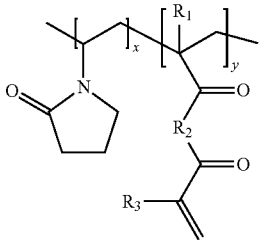
where the molar ratio of x:y is 50:50-99:1;
$R_1$ and $R_3$ are respectively one selected independently from —H and —$CH_3$; and $R_2$ is one selected from
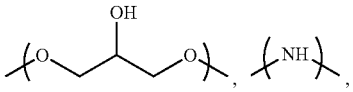
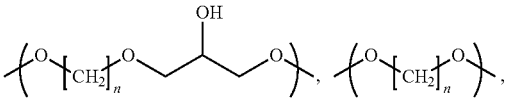
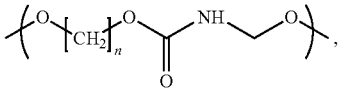
where n is an integer of 1-4.

The structure of the modified acrylate copolymer is as shown by formula A3:

A3

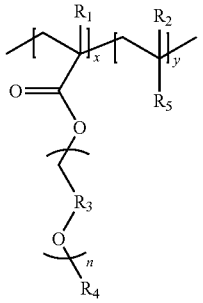

where n is an integer of 1-12;

the molar ratio of x:y is 1:99-99:1, and preferably 50:50-90:10;

$R_1$ and $R_2$ are selected independently from hydrogen, halogen, cyano, methyl or ethyl;

$R_3$ is one selected from alkyl groups of C1-C3;

$R_4$ is one selected from alkyl groups of C1-C6 and alkyl groups of terminal hydroxyl substituted C1-C6; and $R_5$ is one selected from alkyl groups of C1-C4, cycloalkyl groups of C3-C10, alkoxy groups of C1-C6 or aryl groups of C6-C10; or selected from alkyl groups of C1-C4 linked by ester bond, cycloalkyl groups of C3-C10, alkoxy group of C1-C6 or aryl groups of C6-C10; or selected from alkyl groups of C1-C4 linked by amide bond, cycloalkyl group of C3-C10 or aryl groups of C6-C10; or selected from alkyl groups of C1-C4 linked by carbamate bond, cycloalkyl groups of C3-C10 or aryl groups of C6-C10.

Further, the cross-linking agent in the heat-sensitive layer is a multi-functional acrylate compound and a photopolymerizable prepolymer.

Preferably, the multi-functional acrylate compound is one or more of ethylene glycol dimethyl acrylate, diethylene glycol diacrylate, diethylene glycol dimethyl diacrylate, dipropylene glycol diacrylate (DEGDA), triethylene glycol dimethyl acrylate, tripropylene glycol diacrylate (TPGDA), tripropylene glycol dimethyl acrylate, polyethylene glycol (200-600) diacrylate, polypropylene glycol (400) diacrylate, polypropylene glycol (400) dimethyl acrylate, 1,4-butanediol diacrylate, bisphenol A diacrylate, 1,6-hexanediol diacrylate (HDDA), neopentyl glycol diacrylate, pentaerythritol triacrylate (PETA), hydroxypropyl glycerol triacrylate, hydroxyethyl trimethylolpropane triacrylate, pentaerythritol tetraacrylate (PET4A), di (trimethylolpropane) tetraacrylate and dipentaerythritol hexaacrylate (DPHA).

Preferably, the photopolymerizable prepolymer is epoxy acrylate and polyurethane acrylate; and more preferably the photopolymerizable prepolymer accounts for 10-30 wt % of the total weight of the cross-linking agent.

In order to adjust the sensitivity and imaging accuracy of the heat-sensitive layer, a diluting agent may be added to the heat-sensitive layer in the present invention.

Further, the diluting agent is a low-viscosity compound containing carbon-carbon double bonds.

Preferably, the diluting agent is one or more of isooctyl acrylate, isodecanoate acrylate, lauryl acrylate, hydroxyethyl methacrylate, hydroxypropyl methacrylate, glycidyl methacrylate and dipropylene glycol diacrylate.

Further, the polymerization initiator is an initiator capable of being thermally decomposed to produce free radicals and a photoinitiator with ultraviolet absorbing main peak wavelength smaller than or equal to 300 nm.

Preferably, the initiator capable of being thermally decomposed to produce free radicals is one or more of persulfate, azodiisobutyronitrile (AIBN), 2,2-azobis (2-amidinepropane) dihydrochloride (ABAH), azodiisopentanitrile (AMBN), azodiisoheptanitrile (ADVN), azodicy clohexylcarbonitrile, dimethyl azobisisobutyrate, benzoyl peroxide, tert-butyl peroxybenzoate, lauryl peroxide and methyl ethyl ketone peroxide.

Preferably, the photoinitiator with an ultraviolet absorbing main peak wavelength smaller than or equal to 300 nm is one or more of 2-hydroxy-2-methyl-1-phenylacetone (D aro cur 1173), 1-hydroxycyclohexyl benzophenone (Irgacure 184), tetramethyl Michler's ketone, tetraethyl Michler's ketone, methyl ethyl Michler's ketone, diphenyliodonium hexafluorophosphate, 1,6-p-methyl diphenyliodonium hexafluorophosphate, 1,6-p-tert-butyl diphenyliodonium hexafluorophosphate, 1,6-p-methyl diphenyliodonium hexafluoroantimonate, triphenylsulfonium hexafluorophosphate and triazine.

The infrared absorbing dye in the present invention mainly plays the role of energy transfer, can absorb the light energy of infrared laser, and convert the light energy into heat energy, so as to decompose the polymerization initiator.

Further, the infrared absorbing dye is a benzoindole cyanine dye or a merocyanine dye with a maximum absorption wavelength of 750-850 nm, such as commercialized NK-2014 and NK-2268 of Japan Hayashibara Co., Ltd. and similar products of other companies.

In order to make the image color contrast obvious after exposure, a coloring background dye needs to be added to the heat-sensitive layer.

Further, the coloring background dye is one or more selected from a group consisting of acid blue BRL, acid blue B, acid blue 2R, acid brilliant blue G, acid brilliant blue RLS, Victorian pure blue, indigo, phthalocyanine blue, methyl violet, crystal violet lactone, colorless crystal violet lactone, crystal violet lactone and indolene.

In the present invention, the heat-sensitive layer is coated with the thermosensitive protection layer, and the thermosensitive protection layer is hydrophilic; after exposure, the exposed area of the thermosensitive protection layer and the heat-sensitive layer becomes lipophilic, and the connection between the upper and lower layers is increased; and the hydrophilicity of the non-exposed area remains unchanged and it can be dissolved in water or fountain solution. The thermosensitive protection layer not only increases the image and text fastness of the exposed area, but also does not affect the water developability of the non-exposed area, thus realizing the dual improvement of the developability and the printing resistance.

Further, the thermosensitive protection layer comprises 40-90 parts of water-soluble resin, 10-60 parts of hydrophilic cross-linking agent and 1-30 parts of acid-producing agent; and preferably, the thermosensitive protection layer comprises 60-90 parts of water-soluble resin, 20-40 parts of hydrophilic cross-linking agent and 1-10 parts of acid-producing agent.

Further, the water-soluble resin in the thermosensitive protection layer is one or more selected from a group consisting of polyvinyl alcohol, polyvinyl pyrrolidone, N-vinyl pyrrolidone and vinyl acetate copolymer (VA73, VA64, VA55, VA37), N-vinyl pyrrolidone and (methyl) acrylate copolymer, N-vinyl pyrrolidone and (methyl) acrylamide copolymer, N-vinyl pyrrolidone and styrene copolymer, N-vinyl amide copolymer (marked as A1, introduced from patent application No. 201310158535.7), modified N-vinyl pyrrolidone copolymer (marked as A2, introduced from patent application No. 201410182220.0), modified acrylate copolymer (marked as A3, introduced from patent application No. 201410062775.1), water-borne nylon resin, gelatin and cellulose derivative.

Preferably, the cellulose derivatives may be cellulose nitrate, cellulose acetate, cellulose acetate butyrate and cellulose xanthate, methyl cellulose, carboxymethyl cellulose, ethyl cellulose, hydroxyethyl cellulose, cyanoethyl cellulose, hydroxypropyl cellulose or hydroxypropyl methyl cellulose.

Further, the hydrophilic cross-linking agent is an epoxy compound or vinyl ether monomer containing at least one hydrophilic group; and preferably, the hydrophilic group is hydroxyl, carboxyl and ether bond.

The hydrophilic cross-linking agent is hydroxyethyl vinyl ether, hydroxybutyl vinyl ether (HBVE), diethylene glycol monovinyl ether, diethylene glycol diethyl ether, triethylene glycol diethyl ether (DVE-3), n-butyl glycidyl ether (BGE), allyl glycidyl ether (AGE), 5-ethyl hexyl glycidyl ether (EHAGE), phenyl glycidyl ether (PEG), cresol glycidyl ether (CGE), p-isobutyl phenyl glycidyl ether (BPGE), diethyl glycidyl ether (DGE), polyethanol diglycidyl ether (PEGGE), polypropylene glycol diglycidyl ether (PPGGE), butylene glycol diglycidyl ether (BDGE), trimethyl propane glycidyl ether (TMPGE) or glycerol triglycidyl ether (GGE).

Further, the acid-producing agent is selected from acid-producing agents with ultraviolet absorption main peak wavelength smaller than or equal to 300 nm and white light safety.

Preferably, the acid-producing agent is one or more of iodonium salt, sulfonium salt and triazine derivative.

More preferably, the acid-producing agent is one or more of diphenyliodonium hexafluorophosphate, 1,6-p-methyl diphenyliodonium hexafluorophosphate, 1,6-p-tert-butyl diphenyliodonium hexafluorophosphate, 1,6-p-methyl diphenyliodonium hexafluoroantimonate, triphenylsulfonium hexafluorophosphate and triazine.

The acid-producing agent in the present invention can produce cations by heterolytic dissociation under the effect of heat, and initiate cationic polymerization of the hydrophilic diluting agent in the thermosensitive protection layer.

In the range of not affecting the properties of the planographic printing plate material of the present invention, a surfactant may be added to the heat-sensitive layer and the thermosensitive protection layer as a coating performance improving agent; and a polymerization inhibitor may be added to the heat-sensitive layer and the thermosensitive protection layer as a stabilizing agent. Preferably, the amount of the added surfactant is smaller than or equal to 5 wt % of the solid content of the coating.

The exposed area of the planographic printing plate material of the present invention undergoes cross-linking polymerization reaction to form a dense hardening layer after exposure.

A method for preparing a heat-sensitive treatment-free planographic printing plate material containing a thermosensitive protection layer specifically comprises the following steps:

1) dissolving all components forming the heat-sensitive layer in an organic solvent to prepare coating solution for the heat-sensitive layer;

2) dissolving all components forming the thermosensitive protection layer in a solvent and performing fierce stirring to prepare coating solution for the thermosensitive protection layer;

3) dissolving water-soluble resin in water to prepare hydrophilic coating solution; and 4) uniformly coating the hydrophilic coating solution on the supporting body, and then performing drying to obtain the hydrophilic layer; uniformly coating the coating solution for the heat-sensitive layer on the hydrophilic layer, then performing drying to obtain the heat-sensitive layer; and uniformly coating the coating solution for the thermosensitive protection layer on the heat-sensitive layer, and then performing drying to obtain the heat-sensitive treatment-free planographic printing plate material containing a thermosensitive protection layer.

The heat-sensitive layer and the thermosensitive protection layer of the present invention may be cured under infrared laser irradiation.

After exposure of the planographic printing plate material of the present invention, the heat-sensitive layer undergoes cross-linking polymerization reaction in the exposed area to form a dense hardening layer, which increases the connection between the upper and lower layers, keeps the non-exposed area unchanged, and has only a mechanical interlocking relationship with the supporting body, and can be removed under the effect of external force and aqueous solution.

Further, the solvent is pure water, a mixed solvent of pure water and ethanol or a mixed solvent of pure water and propylene glycol methyl ether.

Further, the organic solvent is preferably one or more of ether, diol ether ester, acyclic ester, cyclic ester, ketone and tetrahydrofuran.

Preferably, the ether is one or more selected from a group consisting of diethylene glycol dimethyl ether, diethylene glycol monomethyl ether, propylene glycol methyl ether, ethylene glycol ether and propylene glycol butyl ether; the diethylene glycol ether ester is one or more selected from a group consisting of ethylene glycol ether acetate, propylene glycol methyl ether acetate and ethylene glycol methyl ether acetate; the acyclic ester is one or more selected from a group consisting of ethyl lactate, butyl acetate, amyl acetate and ethyl ketonate; the cyclic ester is gamma-butyrolactone, etc.; and the ketone is one or more selected from a group consisting of acetone, butanone, cyclohexanone, methyl isobutyl ketone and 2-heptanone.

Further, the coating method is not specially limited and is a well-known coating method for a planographic printing plate; preferably, the coating method is air knife coating method, scraping plate coating method, metal bar coating method, scraping blade coating method, dip coating method, gravure coating method, tape casting coating method, spin coating method or extrusion coating method, etc.

Further, the drying temperature is 80-150° C.; and preferably, the drying temperature is 90-130° C.

Further, the dry coating weight of t the hydrophilic layer on the supporting body is 0.001-0.1 $g/m^2$; the dry coating weight of the heat-sensitive layer on the hydrophilic layer is 0.1-10 $g/m^2$; and the dry coating weight of the thermosensitive protection layer on the heat-sensitive layer is 0.1-5 $g/m^2$.

Application of a heat-sensitive treatment-free planographic printing plate material containing a thermosensitive protection layer is provided, the planographic printing plate material is used for exposure in a wavelength range of 750-1200 nm, and a light source for exposure comes from an infrared laser light source.

The planographic printing plate material of the present invention may also be used as a CTP treatment-free planographic printing plate material. The thermosensitive protection layer in the planographic printing plate material can not only isolate oxygen and prevent the heat-sensitive layer from being subjected to the oxygen-caused polymerization inhibition, but also realize thermosensitive polymerization reaction and improve the binding force with the next layer, such that the printing plate image provided thereby has high precision, good developability and high printing resistance.

As a scanning method of infrared laser, it includes cylindrical outer wall scanning, cylindrical inner wall scanning or plane scanning, etc.

After image exposure, water is used to develop the image. The development temperature is 15-25° C.

The present invention has the following beneficial effects:

The planographic printing plate material of the present invention can be used for exposure in the wavelength range of 750-1200 nm, and can also be used as a CTP treatment-free planographic printing plate material. The thermosensitive protection layer in the planographic printing plate material can not only isolate oxygen and prevent the heat-sensitive layer from being subjected to the oxygen-caused polymerization inhibition, but also realize thermosensitive polymerization reaction and improve the binding force with the next layer, such that the printing plate image provided thereby has high precision, good developability and high printing resistance. Therefore, the combined use of the thermosensitive protection layer and the heat-sensitive layer of the present invention can ensure the water developability and simultaneously obtain an on-machine development type planographic printing plate with good resolution and high printing resistance.

DESCRIPTION OF THE EMBODIMENTS

In order to more clearly describe the present invention, the present invention will be further described below in connection with the preferred embodiments. One skilled in the art should understand that the content described below is descriptive rather than restrictive and should not limit the protection scope of the present invention.

Embodiment 1

A heat-sensitive treatment-free planographic printing plate material containing a thermosensitive protection layer is provided. The planographic printing plate material sequentially comprises a supporting body, a hydrophilic layer, a heat-sensitive layer and a thermosensitive protection layer from bottom to top.

Supporting body: an aluminum plate base pre-treated in advance and meeting the following conditions: aluminum plate base size: 1030 mm*800 mm; aluminum plate base thickness: 0.28-0.3 mm; grain specification: $R_a$=0.5-0.6 um; $R_h$=0.3-0.35 um; anodic oxide film weight: 3.0-3.5 g/m$^2$.

Hydrophilic layer: a hydrophilic layer with dry coating weight of 0.02 g/m$^2$ obtained by extrusion coating of 0.5% polyvinyl alcohol 2488 aqueous solution on the supporting body and drying for 1 minute at 100° C.

Heat-sensitive layer: a heat-sensitive layer with dry coating weight of 1.3 g/m$^2$ obtained by extrusion coating heat-sensitive layer coating solution on the hydrophilic layer prepared above and drying for 3 minutes at 100° C.

Formula of heat-sensitive coating solution:

| | |
|---|---|
| Film-forming resin (see Table 1) | 3.0 g; |
| Cross-linking agent: | |
| Multi-functional acrylate compound (see Table 1) | 5.0 g; |
| Epoxy acrylate oligomer EAO104 (provided by Shanghai Polynaisse Resources Chemicals Co.) | 1.0 g; |
| Diluting agent: | |
| Hydroxyethyl methacrylate (embodiments 1-10 and comparative examples 1-9) | 1.0 g; |
| Or diluting agent (embodiments 11-20) | 0.0 g; |
| Polymerization initiator (see Table 1) | 0.4 g; |
| Infrared absorbing dye NK-2268 | 0.2 g; |
| Crystal violet lactone | 0.2 g; |
| Acid brilliant blue | 0.2 g; |
| Butanone | 30 g; |
| Propylene glycol monomethyl ether | 40 g; |
| Propylene glycol monomethyl ether acetate | 20 g |

Thermosensitive protection layer: a thermosensitive protection layer with dry coating weight of 1.5 g/m$^2$ obtained by extrusion coating of thermosensitive protection layer coating solution on the heat-sensitive layer prepared above and drying for 3 minutes at 100° C.

Formula of the thermosensitive protection layer coating solution:

| | |
|---|---|
| Water-soluble resin (see Table 2) | 0.7 g; |
| Hydrophilic cross-linking agent (see Table 2) | 0.25 g; |
| Acid-producing agent (see table 2) | 0.05 g; |
| Surfactant FC-102 | 0.001 g; |
| Pure water | 50.0 g; |
| Ethanol | 50.0 g |

The difference between embodiments 1-5 and embodiments 6-20 lies in that there is no hydrophilic layer between the supporting body and the heat-sensitive layer in embodiments 1-5, the heat-sensitive coating solution is directly extruded and coated on the supporting body to obtain the heat-sensitive layer, the printed plate structurally and sequentially comprises a thermosensitive protection layer, a heat-sensitive layer and a supporting body from top to bottom, and the formulas of the heat-sensitive layer coating solution and the thermosensitive protection layer coating solution are as described above.

Exposure Experiment

A Kodak Trendsetter heat-sensitive CTP plate making machine was used to expose planographic printing plate materials in the above-mentioned embodiments and comparative examples, and the exposure energy was set to 100 mJ/cm$^2$.

Water Developability Experiment

1) The exposed planographic printing plate materials in the above-mentioned embodiments and comparative examples were placed in pure water at 20° C. and stood for 10 seconds, and then the planographic printing plate materials were gently wiped with sponge to remove the unexposed part and leave the exposed area.

2) Evaluation of water developability: when the unexposed part was completely removed, it was evaluated as "clean", when there was a small amount of residual photosensitive layer, it was evaluated as "relatively clean", and when there was a significant residual film or the developability was poor, it was evaluated as "poor".

Evaluation of resolution for situations "clean" in the evaluation of water developability: if 2% of dots and 20 n.m fine lines were clear, it was evaluated as "good"; if 5% of dots and 40 n.m fine lines were clear, it was evaluated as "relatively good"; and if the reproducibility was more than 10% of dots, it was evaluated as "poor".

Printing resistance observation was further performed for situations "clean" in the evaluation of water developability.

On-Printing-Machine Development Experiment

The same exposed undeveloped printing plate materials were directly hung to a printing machine, ink supply was set to zero at the beginning, and fountain solution was fully supplied to the plate to start printing. If the normal print on the premise that the plate was not dirtied could be obtained from the beginning to less than 100 pieces, the on-machine developability would be evaluated as "good"; if the normal print on the premise that the plate was not dirtied could be obtained from less than 200 pieces, the on-machine developability would be evaluated as "relatively good"; and if the normal print on the premise that the plate was not dirtied could be obtained from more than 200 pieces, the on-machine developability would be evaluated as "poor".

The evaluation results obtained according to the above-mentioned method were as shown in Table 3.

TABLE 1

Formula of heat-sensitive layer

| Embodiment | Film-forming resin | Cross-linking agent | Polymerization initiator |
|---|---|---|---|
| 1 | Polystyrene | PETA | Azodiisobutyronitrile |
| 2 | Polystyrene | DPHA | Azodiisobutyronitrile |
| 3 | Polystyrene | PET4A | Azodicyclohexylcarbonitrile |
| 4 | Polybutyl isobutylene ester | PET4A | Azodicyclohexylcarbonitrile |
| 5 | Polybutyl isobutylene ester | PET4A | Benzoyl peroxide |
| 6 | A1-2 | PETA | tert-butyl peroxybenzoate |
| 7 | A1-18 | DEGDA | Darocur 1173 |
| 8 | Polyethyl isobutylene ester | DPHA | Benzoyl peroxide |
| 9 | Cellulose acetate butyrate | DEGDA | Benzoyl peroxide |
| 10 | Polymethacrylate | 1,4-butanediol diacrylate | Darocur 1173 |
| 11 | Polymethacrylate | DPHA | Irgacure184 |
| 12 | A2 | DPHA | Methyl ethyl Michler's ketone |
| 13 | Polymethyl methacrylate | 1,4-butanediol diacrylate | Diphenyliodonium hexafluorophosphate |
| 14 | A3 | Bisphenol A diacrylate | Diphenyliodonium hexafluorophosphate |
| 15 | Polybutyl methacrylate | Bisphenol A diacrylate | 1,6-p-methyl diphenyliodonium hexafluorophosphate |
| 16 | Polybutyl methacrylate | PET4A | 1,6-p-tert-butyl diphenyliodonium hexafluorophosphate |
| 17 | polyvinyl acetate | PET4A | 1,6-p-methyl diphenyliodonium hexafluoroantimonate |
| 18 | Polystyrene | PET4A | Triphenylsulfonium hexafluorophosphate |
| 19 | Polyisobutyl methacrylate | DPHA | Triazine |
| 20 | Polyvinyl butyral | DPHA | Triazine |
| Comparative example 1 | | The same as Embodiment 13 | |
| Comparative example 2 | | The same as Embodiment 13 | |
| Comparative example 3 | | The same as Embodiment 13 | |
| Comparative example 4 | | The same as Embodiment 13 | |
| Comparative example 5 | Polyvinyl pyrrolidone K30 | 1,4-butanediol diacrylate | Diphenyliodonium hexafluorophosphate |
| Comparative example 6 | Polymethyl methacrylate (Mw smaller than20000) | 1,4-butanediol diacrylate | Diphenyliodonium hexafluorophosphate |
| Comparative example 7 | | The same as Embodiment 13 | |
| Comparative example 8 | | The same as Embodiment 13 | |
| Comparative example 9 | | The same as Embodiment 13 | |

TABLE 2

| Formula of thermosensitive protection layer | | | |
|---|---|---|---|
| Embodiment | Water-soluble resin | Hydrophilic cross-linking agent | Acid-producing agent |
| 1 | Polyvinyl alcohol | hydroxyethyl vinyl ether | Diphenyliodonium hexafluorophosphate |
| 2 | Polyvinyl pyrrolidone | hydroxyethyl vinyl ether | Diphenyliodonium hexafluorophosphate |
| 3 | VA 64 | HBVE | Diphenyliodonium hexafluorophosphate |
| 4 | VA 55 | GGE | Diphenyliodonium hexafluorophosphate |
| 5 | VA 37 | HBVE | Diphenyliodonium hexafluorophosphate |
| 6 | Polyvinyl alcohol | GGE | Triphenylsulfonium hexafluorophosphate |
| 7 | VA 55 + VA 64 at mixing ratio 1:1 | Butylene glycol diglycidyl ether | 1,6-p-methyl diphenyliodonium hexafluoroantimonate |
| 8 | VA 64 | Butylene glycol diglycidyl ether | 1,6-p-methyl diphenyliodonium hexafluoroantimonate |
| 9 | Hydroxypropyl methyl cellulose | DVE-3 | 1,6-p-methyl diphenyliodonium hexafluoroantimonate |
| 10 | Hydroxyethyl cellulose | BGE | Triazine |
| 11 | Water-borne nylon resin | DVE-3 | Triazine |
| 12 | Gelatin | DVE-3 | Triazine |
| 13 | Carboxymethyl cellulose | DVE-3 | Triazine |
| 14 | A1-10 | BGE | Triphenylsulfonium hexafluorophosphate |
| 15 | A1-10 | AGE | Triphenylsulfonium hexafluorophosphate |
| 16 | A1-2 | AGE | Triphenylsulfonium hexafluorophosphate |
| 17 | A1-5 | BPGE | Triphenylsulfonium hexafluorophosphate |
| 18 | A2 | BPGE | Diphenyliodonium hexafluorophosphate |
| 19 | A3 | PPGGE | Diphenyliodonium hexafluorophosphate |
| 20 | A3 | PEGGE | Diphenyliodonium hexafluorophosphate |
| Comparative example 1 | Polyvinyl butyral | DVE-3 | Diphenyliodonium hexafluorophosphate |
| Comparative example 2 | VA 64 | TPGDA | Diphenyliodonium hexafluorophosphate |
| Comparative example 3 | VA 64 | DVE-3 | tert-butyl peroxybenzoate |
| Comparative example 4 | VA 64 | DVE-3 | Darocur 1173 |
| Comparative example 5 | VA 64 | DVE-3 | Diphenyliodonium hexafluorophosphate |
| Comparative example 6 | VA 64 | DVE-3 | Diphenyliodonium hexafluorophosphate |
| Comparative example 7 | Polyvinyl alcohol 0588 | None | None |
| Comparative example 8 | Polyvinyl alcohol 0588 | DVE-3 | None |
| Comparative example 9 | Polyvinyl alcohol 0588 | None | Diphenyliodonium hexafluorophosphate |

TABLE 3

| Evaluation results of water-developable heat-sensitive CTP plate | | | | |
|---|---|---|---|---|
| Embodiment | Water develop-ability | Resolution | Printing resistance (prints) | On-machine develop-ability |
| 1 | Clean | Good | >80,000 | Relatively good |
| 2 | Clean | Good | >80,000 | Relatively good |
| 3 | Clean | Good | >100,000 | Relatively good |
| 4 | Clean | Good | >80,000 | Relatively good |

TABLE 3-continued

| Evaluation results of water-developable heat-sensitive CTP plate | | | | |
|---|---|---|---|---|
| Embodiment | Water develop-ability | Resolution | Printing resistance (prints) | On-machine develop-ability |
| 5 | Clean | Good | >80,000 | Relatively good |
| 6 | Clean | Good | >50,000 | Good |
| 7 | Clean | Good | >50,000 | Good |
| 8 | Clean | Good | >50,000 | Good |

TABLE 3-continued

Evaluation results of water-developable heat-sensitive CTP plate

| Embodiment | Water develop-ability | Resolution | Printing resistance (prints) | On-machine develop-ability |
|---|---|---|---|---|
| 9 | Clean | Good | >50,000 | Good |
| 10 | Clean | Good | >50,000 | Good |
| 11 | Clean | Good | >50,000 | Good |
| 12 | Clean | Good | >50,000 | Good |
| 13 | Clean | Good | >50,000 | Good |
| 14 | Clean | Good | >50,000 | Good |
| 15 | Clean | Good | >50,000 | Good |
| 16 | Clean | Good | >50,000 | Good |
| 17 | Clean | Good | >50,000 | Good |
| 18 | Clean | Good | >50,000 | Good |
| 19 | Clean | Good | >50,000 | Good |
| 20 | Clean | Good | >50,000 | Good |
| Comparative example 1 | Poor | \ | \ | Poor |
| Comparative example 2 | Clean | Relatively good | <5,000 | Good |
| Comparative example 3 | Clean | Relatively good | <5,000 | Good |
| Comparative example 4 | Clean | Relatively good | <5,000 | Good |
| Comparative example 5 | Clean | Good | <10,000 | Good |
| Comparative example 6 | Clean | Good | <10,000 | Good |
| Comparative example 7 | Clean | Relatively good | <3,000 | Good |
| Comparative example 8 | Clean | Relatively good | <3,000 | Good |
| Comparative example 9 | Clean | Relatively good | <3,000 | Good |

Conclusion: from embodiments 1-20, it can be seen that the results of any embodiments show good water developability, good on-machine developability, good resolution and good printing resistance greater than 50,000 prints.

By comparing Table 1 and Table 2, it can be seen that comparative examples 1-4 and 7-9 adopt the same heat-sensitive layer, the difference lies in that the components of the heat-sensitive layer are different. The resin of the heat-sensitive layer in comparative example 1 is the film-forming resin described in the heat-sensitive layer, which is not water-soluble. From Table 3, it can be seen that the water developability of comparative example 1 is very poor; the hydrophilic cross-linking agent of the heat-sensitive layer in comparative example 2 is the multi-functional acrylate in the heat-sensitive layer, free radical polymerization reaction occurs, it is subjected to oxygen-caused polymerization inhibition and the degree of polymerization is limited; in comparative examples 3 and 4, the acid-producing agents in the thermosensitive protection layers are respectively the initiator described in the heat-sensitive layer, free radicals are produced after heating, and the same free radical polymerization reaction occurs, and the degree of polymerization is limited due to oxygen-caused polymerization inhibition; similarly, the components of the thermosensitive protection layer in comparative examples 7-8 are incomplete, polymerization reaction cannot occur, the infrared laser exposed and non-exposed areas cannot form a contrast, and thus it can be seen from Table 3 that the water developability of comparative examples 1-4 and 7-9 is acceptable, but the printing resistance is greatly reduced and the resolution is not as good as that of the embodiments; the thermosensitive protection layer in comparative examples 5 and 6 is consistent with that in the embodiments, but the film-forming resin of the heat-sensitive layer is not the film-forming resin of the present invention, but water-oil-soluble resin without double bonds or oil-soluble resin with a low average molecular weight is adopted, and the results show that the printing resistance is not as good as that of the embodiments. The above-mentioned results show that the combined use of the thermosensitive protection layer and the heat-sensitive layer of the present invention can ensure the water developability, and simultaneously obtain the on-machine development type printing plate with good resolution and high printing resistance.

Obviously, the above-mentioned embodiments of the present invention are merely examples to clearly describe the embodiments of the present invention, rather than limitations to the embodiments of the present invention. One skilled in the art may make other changes or variations on the basis of the above-mentioned description. It is impossible to exhaust all the embodiments here, and all obvious changes or variations derived from the technical solution of the present invention are still included in the protection scope of the present invention.

The invention claimed is:

1. A heat-sensitive treatment-free planographic printing plate material, wherein:

the planographic printing plate material sequentially comprises a supporting body, a hydrophilic layer, a heat-sensitive layer and a thermosensitive protection layer from bottom to top;

the thermosensitive protection layer comprises 40-90 parts of water-soluble resin, 10-60 parts of hydrophilic cross-linking agent and 1-30 parts of acid-producing agent;

the heat-sensitive layer comprises the following components in parts by weight:

10-60 parts of film-forming resin, 30-90 parts of cross-linking agent, 0-40 parts of diluting agent, 1-30 parts of polymerization initiator, 1-10 parts of infrared absorbing dye, and 0.1-10 parts of coloring background dye;

the hydrophilic layer comprises water-soluble resin, and the dry coating weight of the hydrophilic layer on the supporting body is 0.001-0.1 g/m$^2$; and the film-forming resin in the heat-sensitive layer is one or more of oil-soluble polymer with a weight-average molecular weight of 20000-100000 and water-oil-soluble polymer with a weight-average molecular weight of 10000-200000.

2. The planographic printing plate material according to claim 1, wherein the dry coating weight of the heat-sensitive layer on the hydrophilic layer is 0.1-10 g/m$^2$; and the dry coating weight of the thermosensitive protection layer on the heat-sensitive layer is 0.1-5 g/m$^2$.

3. The planographic printing plate material according to claim 1, wherein the water-soluble resin in the hydrophilic layer is one or more selected from a group consisting of polyvinyl alcohol, polyvinyl pyrrolidone, water-borne nylon resin, gelatin and cellulose derivative.

4. The planographic printing plate material according to claim 1, wherein the water-soluble resin in the thermosensitive protection layer is one or more selected from a group consisting of polyvinyl alcohol, polyvinyl pyrrolidone, N-vinyl pyrrolidone and vinyl acetate copolymer, N-vinyl pyrrolidone and (methyl) acrylate copolymer, N-vinyl pyrrolidone and (methyl) acrylamide copolymer, N-vinyl pyrrolidone and styrene copolymer, N-vinyl amide copolymer, modified N-vinyl pyrrolidone copolymer, modified acrylate copolymer, water-borne nylon resin, gelatin and cellulose derivative.

5. The planographic printing plate material according to claim 1, wherein the hydrophilic cross-linking agent is hydroxyethyl vinyl ether, hydroxybutyl vinyl ether, diethylene glycol monovinyl ether, diethylene glycol diethyl ether, triethylene glycol diethyl ether, n-butyl glycidyl ether, allyl glycidyl ether, 5-ethyl hexyl glycidyl ether, phenyl glycidyl ether, cresol glycidyl ether, p-isobutyl phenyl glycidyl ether, diethyl glycidyl ether, polyethanol diglycidyl ether, polypropylene glycol diglycidyl ether, butylene glycol diglycidyl ether, trimethyl propane glycidyl ether or glycerol triglycidyl ether.

6. The planographic printing plate material according to claim 1, wherein the acid-producing agent is an acid-producing agent with an ultraviolet absorbing main peak wavelength smaller than or equal to 300 nm, including diphenyliodonium hexafluorophosphate, 1,6-p-methyl diphenyliodonium hexafluorophosphate, 1,6-p-tert-butyl diphenyliodonium hexafluorophosphate, 1,6-p-methyl diphenyliodonium hexafluoroantimonate, triphenylsulfonium hexafluorophosphate or triazine.

7. The planographic printing plate material according to claim 1, wherein:

the cross-linking agent in the heat-sensitive layer is a multi-functional acrylate compound and a photopolymerizable prepolymer;

the multi-functional acrylate compound is one or more of ethylene glycol dimethyl acrylate, diethylene glycol diacrylate, diethylene glycol dimethyl diacrylate, dipropylene glycol diacrylate, triethylene glycol dimethyl acrylate, tripropylene glycol diacrylate, tripropylene glycol dimethyl acrylate, polyethylene glycol diacrylate, polypropylene glycol diacrylate, polypropylene glycol dimethyl acrylate, 1,4-butanediol diacrylate, bisphenol A diacrylate, 1,6-hexanediol diacrylate, neopentyl glycol diacrylate, pentaerythritol triacrylate, hydroxypropyl glycerol triacrylate, hydroxyethyl trimethylolpropane triacrylate, pentaerythritol tetraacrylate, di (trimethylolpropane) tetraacrylate and dipentaerythritol hexaacrylate;

the diluting agent is one or more of isooctyl acrylate, isodecanoate acrylate, lauryl acrylate, hydroxyethyl methacrylate, hydroxypropyl methacrylate, glycidyl methacrylate and dipropylene glycol diacrylate;

the infrared absorbing dye is a benzoindole cyanine dye or a merocyanine dye;

the coloring background dye is one or more of acid blue BRL, acid blue B, acid blue 2R, acid brilliant blue G, acid brilliant blue RLS, Victorian pure blue, indigo, phthalocyanine blue, methyl violet, crystal violet lactone, colorless crystal violet lactone, crystal violet lactone and indol ene; and the polymerization initiator is an initiator capable of being thermally decomposed to produce free radicals and a photoinitiator with ultraviolet absorbing main peak wavelength smaller than or equal to 300 nm.

8. The planographic printing plate material according to claim 7, wherein;

the oil-soluble polymer is one or more selected from a group consisting of polystyrene, polybutyl isobutylene ester, polyethyl isobutylene ester, polymethyl isobutylene ester, polymethacrylate, polymethyl methacrylate, polyethyl methacrylate, polybutyl methacrylate, polyisobutyl methacrylate, polyvinyl acetate, polyvinyl chloride, styrene/acrylonitrile copolymer, cellulose acetate butyrate and polyvinyl butyral; and the water-oil-soluble polymer is one or more selected from a group consisting of N-vinylamide copolymer, modified N-vinylpyrrolidone copolymer and modified acrylate copolymer.

9. The planographic printing plate material according to claim 7, wherein;

the initiator capable of being thermally decomposed to produce free radicals is one or more of persulfate, azodiisobutyronitrile, 2,2-azobis (2-amidinepropane) dihydrochloride, azodiisopentanitrile, azodiisoheptanitrile, azodicyclohexylcarbonitrile, dimethyl azobisisobutyrate, benzoyl peroxide, tert-butyl peroxybenzoate, lauryl peroxide and methyl ethyl ketone peroxide; and the photoinitiator with an ultraviolet absorbing main peak wavelength smaller than or equal to 300 nm is one or more of 2-hydroxy-2-methyl-1-phenylacetone, 1-hydroxycyclohexyl benzophenone, tetramethyl Michler's ketone, tetraethyl Michler's ketone, methyl ethyl Michler's ketone, diphenyliodonium hexafluorophosphate, 1,6-p-methyl diphenyliodonium hexafluorophosphate, 1,6-p-tert-butyl diphenyliodonium hexafluorophosphate, 1,6-p-methyl diphenyliodonium hexafluoroantimonate, triphenylsulfonium hexafluorophosphate and triazine.

10. The planographic printing plate material according to claim 1, wherein the heat-sensitive layer and the thermosensitive protection layer of the present invention are cured by exposure to infrared light in a wavelength range of 750-1200 nm, and a light source for the exposure comes from an infrared laser light source.

* * * * *